US010468778B2

(12) United States Patent
Caratelli et al.

(10) Patent No.: US 10,468,778 B2
(45) Date of Patent: Nov. 5, 2019

(54) BLADE ANTENNA AND WIRELESS LOCAL AREA NETWORK COMPRISING A BLADE ANTENNA

(71) Applicant: The Antenna Company International N.V., Curaçao (CW)

(72) Inventors: Diego Caratelli, Duizel (NL); Johan Leo Alfons Gielis, Antwerp (BE)

(73) Assignee: The Antenna Company International N.V., CW Willemstad (CW)

( * ) Notice: Subject to any disclaimer, the term of this patent is extended or adjusted under 35 U.S.C. 154(b) by 220 days.

(21) Appl. No.: 15/513,606

(22) PCT Filed: Sep. 24, 2015

(86) PCT No.: PCT/NL2015/050666
§ 371 (c)(1),
(2) Date: Mar. 23, 2017

(87) PCT Pub. No.: WO2016/048152
PCT Pub. Date: Mar. 31, 2016

(65) Prior Publication Data

US 2017/0294718 A1 Oct. 12, 2017

(30) Foreign Application Priority Data

Sep. 24, 2014 (WO) ..... PCT/NL2014/050652

(51) Int. Cl.
*H01Q 19/09* (2006.01)
*H01Q 9/40* (2006.01)
(Continued)

(52) U.S. Cl.
CPC ..... *H01Q 19/09* (2013.01); *H01Q 9/40* (2013.01); *H01Q 1/2291* (2013.01); *H01Q 1/40* (2013.01); *H01Q 21/28* (2013.01)

(58) Field of Classification Search
CPC ..... H01Q 19/09; H01Q 9/40; H01Q 1/32; H01Q 1/2291; H01Q 1/40; H01Q 21/28
(Continued)

(56) References Cited

U.S. PATENT DOCUMENTS 4,761,654 A * 8/1988 Zaghloul ..... H01Q 9/0414 343/700 MS
7,620,527 B1 11/2009 Gielis
(Continued)

FOREIGN PATENT DOCUMENTS

CN 203826544 9/2014
FR 2 867 904 A1 9/2005
(Continued)

OTHER PUBLICATIONS

International Search Report and the Written Opinion for corresponding International Application No. PCT/NL2015/050666 dated Mar. 14, 2016.
(Continued)

*Primary Examiner* — Hai V Tran
(74) *Attorney, Agent, or Firm* — Renner, Otto, Boisselle & Sklar, LLP

(57) ABSTRACT

Blade antenna suitable for use in a wireless local area network, comprising at least one blade antenna unit and preferably two blade antenna units wherein each unit comprises: —a ground plane, —a first blade structure which is mounted substantially perpendicular onto the ground plane, wherein the ground plane and first blade structure are at least partially made of an electrically conductive material and are electrically insulated from each other, thereby forming a blade antenna, —a body of dielectric material in which the blade structure at least partially is embedded and which functions as a lens structure for electromagnetic waves received or transmitted by the blade antenna.

19 Claims, 2 Drawing Sheets

(51) Int. Cl.
*H01Q 1/22* (2006.01)
*H01Q 1/40* (2006.01)
*H01Q 21/28* (2006.01)

(58) Field of Classification Search
USPC ..... 343/700 MS, 713, 753
See application file for complete search history.

(56) References Cited

U.S. PATENT DOCUMENTS

| | | | | |
|---|---|---|---|---|
| 8,009,107 | B2 * | 8/2011 | Li | H01Q 5/35 343/700 MS |
| 8,736,506 | B1 | 5/2014 | Brock et al. | |
| 2007/0188389 | A1 | 8/2007 | Pintos et al. | |
| 2007/0229363 | A1 | 10/2007 | Kurashima et al. | |
| 2010/0019979 | A1 | 1/2010 | Buxton et al. | |
| 2015/0236428 | A1 * | 8/2015 | Caratelli | H01Q 5/35 343/755 |
| 2017/0222321 | A1 * | 8/2017 | Caratelli | H01Q 9/0407 |

FOREIGN PATENT DOCUMENTS

| | | |
|---|---|---|
| JP | 2000138521 | 5/2000 |
| WO | 2014046537 | 3/2014 |

OTHER PUBLICATIONS

Notice of First Office Action in corresponding Chinese application 201580059893.X dated Jan. 3, 2019.

* cited by examiner

BLADE ANTENNA AND WIRELESS LOCAL AREA NETWORK COMPRISING A BLADE ANTENNA

This application is a national phase of International Application No. PCT/NL2015/050666 filed Sep. 24, 2015 and published in the English language, which claims priority to International Application No. PCT/NL2014/050652 filed Sep. 24, 2014.

The present invention relates to a blade antenna suitable for use in a wireless local area network, comprising at least one blade antenna unit and preferably two blade antenna units wherein each unit comprises:

a ground plane, a first blade structure which is mounted substantially perpendicular onto the ground plane, wherein the ground plane and first blade structure are at least partially made of an electrically conductive material and are electrically insulated from each other, thereby forming a blade antenna.

Blade antennas are commonly used for transceiving radio signals, and are derived from a monopole antenna which is based on a rod-shaped pole which is perpendicularly positioned onto a ground plane. The blade antenna differs from the monopole antenna in that the rod-shaped pole is substituted by a planar structure or a blade, which is perpendicularly positioned onto a ground plane. Both the blade and the ground plane need to be at least partially made of an electrically conductive material in order to function as an antenna.

Blade antennas are in general known to have broad band characteristics which makes them a priori less attractive for use in wireless local area networks (WLAN) such as WiFi. The WiFi standard typically uses a frequency of 2.4 and 5.0 GHz for transmission of radio signals. An antenna suitable for a WLAN such as WiFi, should have a sufficiently defined bandwidth in regard of both frequency bands. On the other hand, blade antennas have an attractive property of a relatively high efficiency, which is the ratio of the power radiated by the antenna relative to the power that is absorbed by the antenna (mostly as heat energy) and is not used for the purpose of radiation.

The objective of the present invention is to develop a blade antenna which is suitable for use in a wireless local area network. In addition, it is an objective to provide a blade antenna that can be integrated in an access point or bridge for use in a WLAN, which encompasses both indoor and outdoor use.

The above objective is met by providing a blade antenna as described in the preamble, wherein each blade antenna unit comprises a body of dielectric material in which the blade structure at least partially is embedded and which functions as a lens structure for electromagnetic waves received or transmitted by the blade antenna. Typically, the blade structure is embedded completely in the lens structure. As a consequence, the major radiation surfaces of the blade antenna according to the invention are directed towards the outer wall of the surrounding lens structure.

Surprisingly, the provision of such a lens structure results in a blade antenna suitable for use in WLAN purposes, which encompass both indoor and outdoor use. The properties of the blade antenna which make it suitable for the intended use encompass operational bandwidth, efficiency, and gain level (i.e. the directivity of the radiation pattern). Some specific embodiments and their advantageous properties will be shown in examples further below.

The blade antenna may contain one or more blade antenna units, which depends on the intended use. When the blade antenna as a whole is integrated in a wall mounted access point, it is advantageous that it comprises two blade antenna units. When integrated in a ceiling mounted access point, it is advantageous that the blade antenna comprises one blade antenna unit.

When the blade antenna comprises two blade antenna units, it has the advantage of offering redundancy, i.e. a spare unit in case of failure of the other. Also, in case one unit is hampered in transceiving signals for instance by interference, the other may—for its different position—still be effective.

Preferably, the blade antenna according to the invention, is designed such that one and preferably each blade antenna unit comprises a first blade structure having a circumference which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with a, b $\in \mathbb{R}^+$; $m_1$, $m_2$, $n_1$, $n_2$, $n_3 \in \mathbb{R}$ ; a, b, $n_1 \neq 0$ and wherein:

$\rho_d(\varphi)$ is a curve located in the XY-plane; and $\varphi \in [0, 2\pi)$ is the angular coordinate.

This polar function is also referred to as a supershape which is described in U.S. Pat. No. 7,620,527 to J. Gielis. The patent explains how most geometrical forms and regular shapes, including circles and polygons, can be described as special realizations of the above polar function's formula. By selection or so-called modulation of the rotational symmetries ($m_1$, $m_2$), exponents ($n_1$, $n_2$, $n_3$), and/or short and long axes (a, b), a wide variety of natural and abstract shapes can be realized. A detailed explanation of the supershape formula is given in the US'527 patent, to which is referred for that purpose.

Alternatively, the polar function defined above as $\rho_d(\varphi)$, can be defined as a summation SF (θ) of a number of polar functions $\rho_i$, as follows:

$$SF(\vartheta) = \sum_{j=1}^{K} \rho_i(\vartheta; f_j(\vartheta), A_j, B_j, m_j, n_{1j}, n_{2j}, n_{3j})$$

$$\text{with } \rho(\vartheta; f(\vartheta), A, B, m, n_1, n_2, n_3) =$$

$$f(\vartheta)\cdot\left[\left|\frac{1}{A}\cos\frac{m\vartheta}{4}\right|^{n_2} + \left|\frac{1}{B}\sin\frac{m\vartheta}{4}\right|^{n_3}\right]^{\frac{1}{n_2}} (m, n_2, n_3, \in \mathbb{R}; n_1, A, B \in \mathbb{R}_0)$$

This alternative definition SF (θ) for polar function $\rho_d(\varphi)$ is valid for all embodiments of the invention throughout the application, where ever $\rho_d(\varphi)$ is indicated as the polar function. Any indicated preferences for parameters of $\rho_d(\varphi)$ which follow herein below, also apply to the alternative definition SF (θ).

It has been found that such a design of the blade structure enhances the suitability of the blade antenna for its intended use.

Preferably, in the blade antenna according to the invention, at least one blade structure has a circumference which is substantially defined by the polar function of:

$$\rho_d(\varphi) = \frac{1}{\sqrt[n_1]{\left|\frac{1}{a}\cos\frac{m_1}{4}\varphi\right|^{n_2} + / -\left|\frac{1}{b}\sin\frac{m_2}{4}\varphi\right|^{n_3}}}$$

with $m_1=m_2=4$, and the convexity parameters $n_1$, $n_2$, $n_3$ being equal and having a value chosen between 1 and 4. As an alternative, while $m_1=m_2=4$ in the above formula, the convexity parameters $n_1$, $n_2$, $n_3$ may have different values in the range between 1 and 4.

With further preference, the blade antenna according to the invention, is designed such that one and preferably each blade antenna unit comprises:

one or more second blade structures mounted substantially perpendicular onto the ground plane, which are at least partially made of an electrically conductive material and are electrically insulated from the ground plane, and which are at least partially embedded in the lens structure.

Such a plurality of blade structures per blade antenna unit, raises the performance of the blade antenna.

In particular it is preferred that one and preferably each second blade structure has a circumference which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with $a, b \in \mathbb{R}^+$; $m_1, m_2, n_1, n_2, n_3 \in \mathbb{R}$; $a, b, n_1 \neq 0$ and wherein:

$\rho_d(\varphi)$ is a curve located in the XY-plane; and $\varphi \in [0, 2\pi)$ is the angular coordinate.

When the blade antenna according to the invention comprises first and second blade structures, it is preferred that at least two and more preferably all are virtually identical. Apart from being easier to produce, the function of the antenna is further enhanced in this way.

In a special embodiment of the blade antenna according to the invention, one and preferably each blade structure of one and preferably of each blade antenna unit, is divided in two main parts that are conductively connected, more preferably the blade structure is divided in an upper part and a lower part. The division is such that the two main parts are for their major part not conductively connected to each other.

The advantage of dividing the blade structure in two parts, is that the division can be chosen such that the dimensions of each individual part is suitable for transceiving radio signals at two different frequencies, also referred to as dual-band capability.

In a mathematical sense, the blade antenna according to the invention, may be described as a supershape which is modified by several Boolean operations. For instance, by Boolean subtraction of a strip, a slot is created which divides the supershape in a lower and an upper part, which is a special embodiment of the above feature of the blade antenna structure being divided in two main parts.

Optionally, by Boolean addition of a strip, each lower part is provided with extensions in the form of a strip near the slot.

In another preferred embodiment of the blade antenna according to the invention, one and preferably each second blade structure of one and preferably of each blade antenna unit, intersects the first blade structure over a common longitudinal axis. Preferably the intersecting of the blade structures is such that at least two blade structures are in a substantially perpendicular orientation to each other.

Such a configuration of blade structures per blade antenna unit, raises the performance of the blade antenna as a whole. In particular, the omni-directionality of the antenna is enhanced by a perpendicular orientation of the two intersecting blades.

In a particular embodiment of the blade antenna according to the invention, one and preferably each blade structure of one and preferably of each blade antenna unit, is configured to operate in the 5 GHz frequency band, wherein the length of said structure is between 4 and 12 mm.

In another particular embodiment of the blade antenna according to the invention, one and preferably each blade structure of one and preferably of each blade antenna unit, is configured to operate in the 2.4 GHz frequency band, wherein the length of said structure is between 8 and 24 mm.

It is preferred in the blade antenna according to the invention, that the height of the lens structure of one and preferably each blade antenna unit, is smaller than or equal to 30 mm, preferably 25 mm or less.

Such a limitation in height is often necessary to integrate the blade antenna into an access point or bridge device for WLAN purposes.

For the same reason of limited space for integrating the blade antenna in an access point or bridge device, more preferred dimensions of the blade antenna are indicated below.

It is further preferred in the blade antenna according to the invention, that the lens structure of one and preferably each blade antenna unit, has a cylindrical shape and preferably a diameter of 10 to 15 mm.

In a preferred embodiment of the blade antenna according to the invention, the dielectric material of the lens structure of one and preferably each blade antenna unit, has a dielectric constant of a value between 2 and 90.

It is further preferred in the blade antenna according to the invention that the lens structure of one and preferably each blade antenna unit, has a refractive index n, wherein $n \neq 1$.

Advantageously, in the blade antenna according to the invention, the ground plane of one and preferably of each blade antenna unit, is a substantially circular plane having a diameter of 10 to 15 mm.

In the blade antenna according to the invention, it is preferred that one and preferably each blade antenna unit is configured to communicate in a first frequency band and a second frequency band. Such a dual-band blade antenna, preferably comprises at least one processor for switching between two frequency bands.

Furthermore, it is a preferred in the blade antenna according to the invention that one and preferably each blade antenna unit comprises a lens structure that has a base profile which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with $a, b \in \mathbb{R}^+$; $m_1, m_2, n_1 n_2, n_3 \in \mathbb{R}$; $a, b, n_1 \neq 0$ and wherein:

$\rho_d(\varphi)$ is a curve located in the XY-plane; and $\varphi \in [0, 2\pi)$ is the angular coordinate.

Such a lens structure further contributes to the suitability of the blade antenna for the intended purposes.

When the blade antenna according to the invention comprises at least two blade antenna units, it is preferred that the individual ground planes of each unit lie in a common plane or on parallel planes. With particular preference, such a blade antenna further features the blade antenna units to be fixed to each other by a spacing structure which is preferably of electrically insulating material.

In the blade antenna comprising at least two blade antenna units according to the invention, it is preferred that the ground planes of the blade antenna units lie in a common plane and at a distance of each other of 60-100 mm, preferably 70-90 mm.

When the blade antenna comprises a spacing structure according to the invention, preferably the spacing structure has a width of 15 mm or less. Furthermore, the spacing structure is preferably made of dielectric polymer, in particular of the composite material FR4.

When the blade antenna contains one blade antenna unit according to the invention, it is preferred that one and more preferably each blade structure has a circumference which is substantially circular or elliptical.

This design has proven most suitable for use when the band antenna is ceiling mounted.

Such a ceiling mounted band antenna preferably has a cylindrical lens structure, with a diameter of 12 to 30 mm and a heights of 15 to 30 mm. The ground plane has preferably a substantially larger diameter than the bottom plane of the cylindrical lens structure.

The lens structure of the blade antennas is preferably constructed by injection moulding over the blade antenna when the selected dielectric material is a thermoplastic polymer. The dielectric may also be a thermosetting polymer, and in that case all known methods in the art of thermosetting polymers may be used to produce the lens around the blades. Alternatively, the lens may be formed out of modular elements that are assembled around the blade antenna and that are held together so that a surrounding lens body is obtained which is composed out of the assembled modular elements.

An effective way for manufacturing the metal blade structure is by photolithographic printing of a metal layer on a thin dielectric layer. The dielectric layer provides mechanical support to the metal blade structure during subsequent over-moulding of the lens structure. The antenna units are fixed on the relevant ground plane by polymer rivets or, as an alternative, by a suitably selected self-adhesive tape.

Preferably, the metal blade structure is formed by depositing a metal layer of identical shape on both sides of the thin dielectric layer. When two metal blade structures are combined in one blade antenna unit, it is preferred that both metal blade structures have an incision along half of their central longitudinal line, so that the two structures can be fixed together mechanically by sliding the incisions into each other.

Alternatively, the metal blade structure may be formed using any appropriate process wherein a solid metal blade structure is formed, in which no additional dielectric layer is present. The blade structure may for instance be formed by cutting of a sheet of metal, or by electrochemical formation of the metal structure on a suitable rigid or flexible carrier by using a mask with appropriate geometry.

On the backside of the ground plane, the antenna front-end and electrical connections are realized by using coaxial cables soldered to matching lines of micro-strip technology.

Preferably the blade antenna according to the invention is integrated in an access point or bridge device for a wireless local area network. As such, the WLAN device is suitable for either a wall or ceiling mounting (dependent on the number blade antenna units), and has an attractive performance for transceiving radio signals.

In a second aspect, the invention relates to a wireless local area network, comprising a plurality of blade antennas, wherein each individual blade antenna is in accordance with one of the preceding claims.

Such a plurality of blade antennas makes it possible to build a Multiple Input Multiple Output (MIMO) system. In a MIMO system, multiple antennas are placed at the input and output side of a communication system to raise the bandwidth efficiency, and hence the acceleration of data rates.

The invention will be further explained by a description of the appended figures wherein:

FIG. 1 shows a three dimensional picture of a blade antenna 1 suitable for a wall mounted access point (WLAN), comprising two identical blade antenna units 3 wherein each unit comprises:

Figure 1:
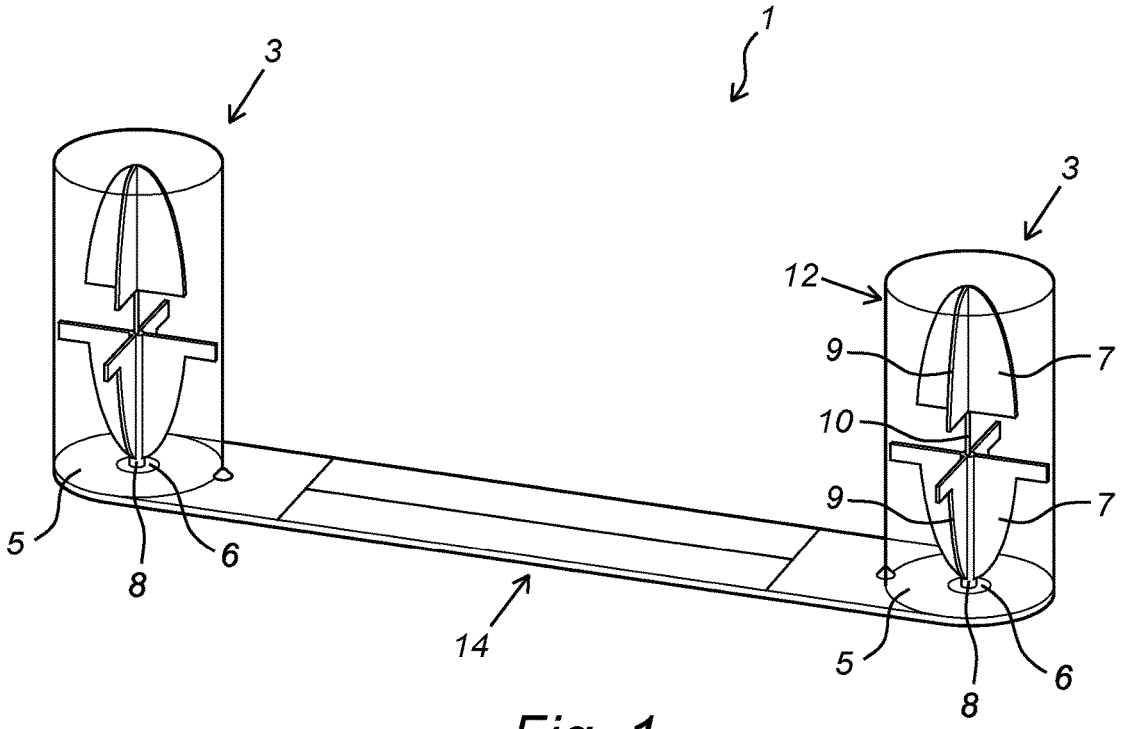
FIG. 1 shows a preferred embodiment of the blade antenna according to the invention.

- a ground plane 5,
- a first blade structure 7 which is mounted substantially perpendicular onto the ground plane 5,
- a second blade structure 9 which is mounted substantially perpendicular onto the ground plane 5.

The blade structures 7,9 and the ground plane 5 are made of an electrically conductive material. The two blade structures are in a substantially perpendicular orientation to each other. Each blade structure 7,9 is divided in an upper part and a lower part which are conductively connected by a rod 10. The second blade structure 9 is connected to the first blade structure 7 over a common axis in line with rod 10. The blade structures 7,9 converge at the bottom pin 8 which is conductively connected to a feed line (not shown) provided on the bottom side of the spacing structure 14. The bottom pin 8 extends through an insulating disk 6 of a dielectric material in the center of the ground plane 5. Consequently, the whole blade structure 7,9 is mounted onto the ground plane 5 while being electrically insulated from the ground plane.

The overall circumference of the blade structures 7,9 is substantially defined by the polar function for a supershape of the Gielis' formula:

$$\rho_d(\varphi) = \frac{1}{\sqrt[n_1]{\left|\frac{1}{a}\cos\frac{m_1}{4}\varphi\right|^{n_2} + \left/ -\left|\frac{1}{b}\sin\frac{m_2}{4}\varphi\right|^{n_3}\right.}}$$

with m1=m2=4, and the convexity parameters n1, n2, n3 being equal and having a value chosen of 2.5. Furthermore, the supershape is modified by several Boolean operations: By Boolean subtraction of a strip a slot is created which divides the supershape in a lower and an upper part. By Boolean addition of a strip, each lower part is provided with extensions in the form of a strip near the slot.

Further, each blade antenna unit 3 comprises a lens structure 12 in the form of a cylindrical body 12 of dielectric material in which the blade structures 7,9 are enclosed and which functions as a lens structure for electromagnetic waves received or transmitted by the blade antenna 1. The bottom plane of the lens structure 12 covers the ground plane 5.

The two blade antenna units 3 are fixed to each other by a spacing structure 14 of electrically insulating material such as used for printed circuit boards, preferably the composite FR4. Not visible are electricity lines at the bottom side of the spacing structure which provide electric feed to the blade structures 7,9.

Figure 2:
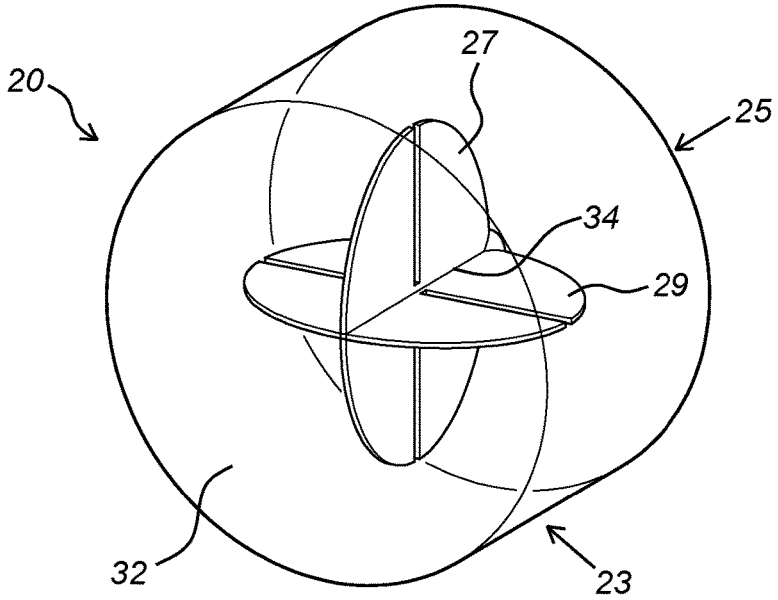
FIG. 2 shows another preferred embodiment of the blade antenna according to the invention.

FIG. 2 shows a three dimensional picture of a blade antenna 20 suitable for a ceiling mounted access point for a WLAN, comprising one blade antenna unit 23 which comprises:

a ground plane 25, a first blade structure 27 which is mounted substantially perpendicular onto the ground plane 25, a second blade structure 29 which is mounted substantially perpendicular onto the ground plane 25.

The blade structures 27,29 and the ground plane 25 are made of an electrically conductive material. The two blade structures are in a substantially perpendicular orientation to each other. Each blade structure 27,29 is divided in an upper part and a lower part which are conductively connected. The second blade structure 25 is connected to the first blade structure 27 over a common longitudinal axis 34. The overall circumference of the blade structures 27,29 is substantially a circle. The ground plane 25 has a significantly larger diameter than the bottom plane of the lens structure 32, e.g. 4- or 5-fold larger.

Analogously to FIG. 1, the blade structures 27,29 converge at a bottom pin (not shown) which is conductively connected to a feed line provided below the ground plane 25. The pin extends through the ground plane 25, while being electrically insulated from the ground plane using an insulating structure that surrounds the pin through the ground plane.

Figure 3:
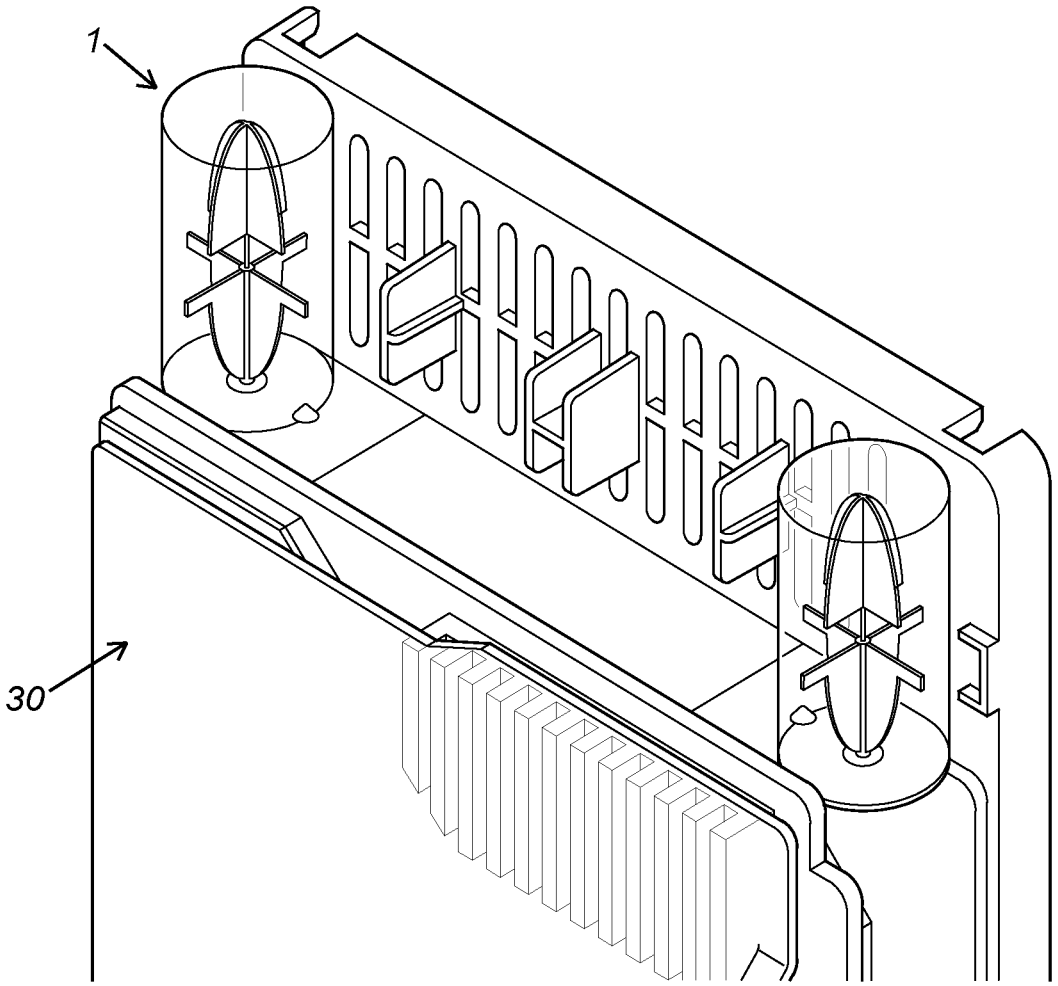
FIG. 3 shows a preferred embodiment of a blade antenna integrated in an access point.

FIG. 3 shows a three dimensional picture of a blade antenna 1 integrated in a wall mounted access point 30 for WLAN. The picture shows the limited space for fitting the blade antenna 1 in the access point 30. The blade antenna 1 is identical to the one pictured in FIG. 1.

EXAMPLES

The blade antenna 1 depicted in FIG. 1, has the following properties:

dual-band operation at 2.4 GHz and 5.0 GHz;

efficiency of 89% at 2.4 GHz and 96% at 5.0 GHz;

peak gain level of 3.3 dBi at 2.4 GHz and 3.2 dBi at 5.0 GHz.

The blade antenna 20 depicted in FIG. 2, has the following properties:

dual-band operation at 2.4 GHz and 5.0 GHz;

efficiency of 95% at 2.4 GHz and 95% at 5.0 GHz;

peak gain level above 2.0 dBi at 2.4 GHz and above 3.0 dBi at 5.0 GHz.

The invention claimed is:

1. Blade antenna suitable for use in a wireless local area network, comprising at least one blade antenna unit comprising:

a ground plane, a first blade structure which is mounted substantially perpendicular onto the ground plane, wherein the ground plane and first blade structure are at least partially made of an electrically conductive material and are electrically insulated from each other, a body of dielectric material in which the blade structure at least partially is embedded and which functions as a lens structure for electromagnetic waves received or transmitted by the blade antenna, wherein the first blade structure of the at least one blade antenna unit is divided in two main parts that are conductively connected, wherein the two main parts are divided in such a way that the two parts are capable of transceiving radio signals at two different frequencies.

2. Blade antenna according to claim 1, wherein the first blade structure has a circumference which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with a, $b \in \mathbb{R}^+$; $m_1$, $m_2$, $n_1$, $n_2$, $n_3 \in \mathbb{R}$ ; a, b, $n_1 \approx 0$ and wherein:

$\rho_d(\varphi)$ is a curve located in the XY-plane; and $\varphi \in [0, 2\pi)$ is the angular coordinate.

3. Blade antenna according to claim 1, wherein the at least one blade antenna unit comprises:

one or more second blade structures mounted substantially perpendicular onto the ground plane, which are at least partially made of an electrically conductive material and are electrically insulated from the ground plane, and which are at least partially embedded in the lens structure.

4. Blade antenna according to claim 3, wherein at least one second blade structure has a circumference which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with a, $b \in \mathbb{R}^+$; $m_1$, $m_2$, $n_1$, $n_2$, $n_3 \in \mathbb{R}$ ; a, b, $n_1 \approx 0$ and wherein:

$\rho_d(\varphi)$ is a curve located in the XY-plane; and $\varphi \in [0, 2\pi)$ is the angular coordinate.

5. Blade antenna according to claim 3, wherein two of the first and second blade structures are virtually identical.

6. Blade antenna according to claim 3, wherein one second blade structure of the at least one blade antenna unit, intersects the first blade structure over a common axis.

7. Blade antenna according to claim 1, wherein the first blade structure of the at least one blade antenna unit, is configured to operate in the 5 GHz frequency band, wherein the length of said structure is between 4 and 12 mm.

8. Blade antenna according to claim 1, wherein the first blade structure of the at least one blade antenna unit, is configured to operate in the 2.4 GHz frequency band, wherein the length of said structure is between 8 and 24 mm.

9. Blade antenna according to claim 1, wherein a height of the lens structure of the at least one blade antenna unit, is smaller than or equal to 30 mm.

10. Blade antenna according to claim 1, wherein the lens structure of the at least one blade antenna unit, has a cylindrical shape.

11. Blade antenna according to claim 1, wherein the dielectric material of the lens structure of the at least one blade antenna unit, has a dielectric constant of between 2 and 90.

12. Blade antenna according to claim 1, wherein the dielectric material of the lens structure of the at least one blade antenna unit, has a refractive index n, wherein $n \approx 1$.

13. Blade antenna according to claim 1, wherein the ground plane of the at least one blade antenna unit, is a substantially circular plane having a diameter of 10 to 15 mm.

14. Blade antenna according to claim 1, wherein the at least one blade antenna unit is configured to communicate in a first frequency band and a second frequency band.

15. Blade antenna according to claim 14, comprising at least one process for switching between two frequency bands.

16. Blade antenna according to claim 1, wherein the lens structure of the at least one antenna unit has a base profile which is substantially defined by the polar function:

$$\rho_d(\varphi) = \frac{1}{\sqrt[n_1]{\left|\frac{1}{a}\cos\frac{m_1}{4}\right|^{n_2} \pm \left|\frac{1}{b}\sin\frac{m_2}{4}\right|^{n_3}}}$$

with a, b$\in\mathbb{R}^+$; $m_1$, $m_2$, $n_1$, $n_2$, $n_3\in\mathbb{R}$ ; a, b, $n_1\approx 0$ and wherein:

$\rho_d(\varphi)$ is a curve located in the XY-plane; and $\varphi\in[0, 2\pi)$ is the angular coordinate.

17. Blade antenna according to claim 1, wherein the blade antenna comprises at least two blade antenna units of which the individual ground planes lie in a common plane or on parallel planes.

18. Blade antenna according to claim 17, wherein the at least two blade antenna units are fixed to each other by a spacing structure.

19. Blade antenna according to claim 1, wherein the first blade structure of the at least one antenna unit has a circumference which is substantially circular or elliptical.

* * * * *